United States Patent [19]

Dupre

[11] 4,022,452

[45] May 10, 1977

[54] POLE GUARD

[76] Inventor: Herman K. Dupre, Seven Springs, Champion, Pa. 15622

[22] Filed: July 22, 1976

[21] Appl. No.: 707,818

[52] U.S. Cl. ..... 267/140; 61/48; 114/219; 256/1

[51] Int. Cl.[2] ..... F16F 7/12

[58] Field of Search ..... 267/139, 140, 141, 153; 114/219; 293/1, 60, 64, 65, 71 R, 72, 80, 81; 61/48; 14/76; 248/176; 256/1, 13.1; 404/6; 211/23, 24; 104/254

[56] References Cited

UNITED STATES PATENTS

| | | | |
|---|---|---|---|
| 2,664,653 | 5/1972 | Walker | 114/219 |
| 3,433,200 | 3/1969 | LeCompte | 114/219 |
| 3,764,446 | 10/1973 | Martin | 293/1 |
| 3,848,853 | 11/1974 | Way et al. | 114/219 |
| 3,975,916 | 8/1976 | Watson | 114/219 |

FOREIGN PATENTS OR APPLICATIONS

| | | | |
|---|---|---|---|
| 863,300 | 3/1941 | France | 114/219 |
| 327,229 | 7/1935 | Italy | 61/48 |
| 592,605 | 5/1959 | Italy | 256/13.1 |

*Primary Examiner*—Trygve M. Blix
*Assistant Examiner*—Edward R. Kazenske
*Attorney, Agent, or Firm*—Carothers and Carothers

[57] ABSTRACT

A yielding guard for attachment to a pole to protect individuals from injury. The pole guard includes a substantially rigid strip of material such as a wood plank that is secured longitudinally to a pole extending upwardly out of the ground. The strip is positioned in spaced relation from the pole by spacers. Worn or used vehicle tires which are larger in diameter than the pole are each provided with diametrically opposed slots in the worn perimetal annular face of the tires. These slots are positioned adjacent one side face of the tire and slidably receive the strip with the aforesaid one side face of the tire facing the pole. The tires may be slid up and down the strip to a desired position and held in place with a stop.

8 Claims, 3 Drawing Figures

POLE GUARD

BACKGROUND OF THE INVENTION

1. Field of Invention

The present invention relates generally to the field of protection guards or bumpers and more particularly to pole guards for the protection of individuals from personal injury in sporting events.

2. Discussion of the Prior Art

Many of the conventional sporting events require the use of poles in the vicinity or area wherein the sporting activity is carried out. For example, in the sport of snow skiing, the ski slopes are provided with a number of spaced snow making towers which are required for the making of artificial snow. These towers or poles can present a hazard to the snow skier, and particularly to the unexperienced skier. The snow skier does not always have full control over his actions when descending the slopes, and accordingly, many personal injuries can result from accidental collision with the snow making poles or towers.

In order to minimize such injuries, pole guards of various types have been supplied in the past, such as the stacking of hay bales in front of the poles, or the attachment of padded guards about the pole.

However, these types of conventional guards deteriorate quickly with the adverse weather conditions to which they are subjected and the padded type pole guard which is tied to the pole in addition is relatively expensive. Another disadvantage with the conventional type padded pole guards is that while they do yield to a limited extent, they do not provide any positive assistance to actually deflect the skier away from the pole upon impact with the guard.

The same problems also occur in other sports, as for example, with the goal posts at either end of the field in football.

It is the principal object of the present invention to eliminate or at least minimize the aforesaid disadvantages and to provide a pole guard which is both simple and economical to construct.

SUMMARY OF THE INVENTION

The pole guard of the present invention comprises a substantially rigid strip of material, such as a strip of wood, secured longitudinally to a pole and in spaced relation from the pole. At least one used vehicle tire which is larger in diameter than the pole is provided with diametrically opposed slots in the worn perimetal annular face of the tire adjacent one side face of the tire. These diametrically opposed slots slidably receive the aforementioned strip therethrough such that the said one side face of the tire faces the pole.

The tire may thus be positioned anywhere along the strip where desired and held in position either by the resistance created by the strip pressing the tire against the pole or by a separate stop which may be positioned anywhere along the vertical strip to prevent the tire from sliding downward. In this manner, any number of such used tires may be vertically positioned in series along the pole and readily repositioned therealong when conditions change, such as when the snow base varies in depth.

The tires may also be painted a fluorescent color or bright color to make them more readily visible.

As the tires are larger in diameter than the pole, the individual making impact with the tire will tend to be deflected away from the pole as the sides of the tire exposed beyond the sides of the pole yield to permit the individual to slide off and away from the pole, and in addition the tendency of the tire to spring back to or recover its original shape tends to positively push the individual out and away from the pole.

In addition, the tires themselves may be used as ladder rungs for initially climbing the pole when repairs must be made to equipment attached to the top.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Referring to the figures, the pole guard 10 of the present invention consists of a substantially rigid strip 11 which is vertically and longitudinally secured to the pole 12. In this instance, the strip 11 is scrap wood, such as a 1 by 4, but of course may be any suitable material such as a metal strip. The pole 12 is also indicated as wood, but could be a metal pole.

Figure 1:
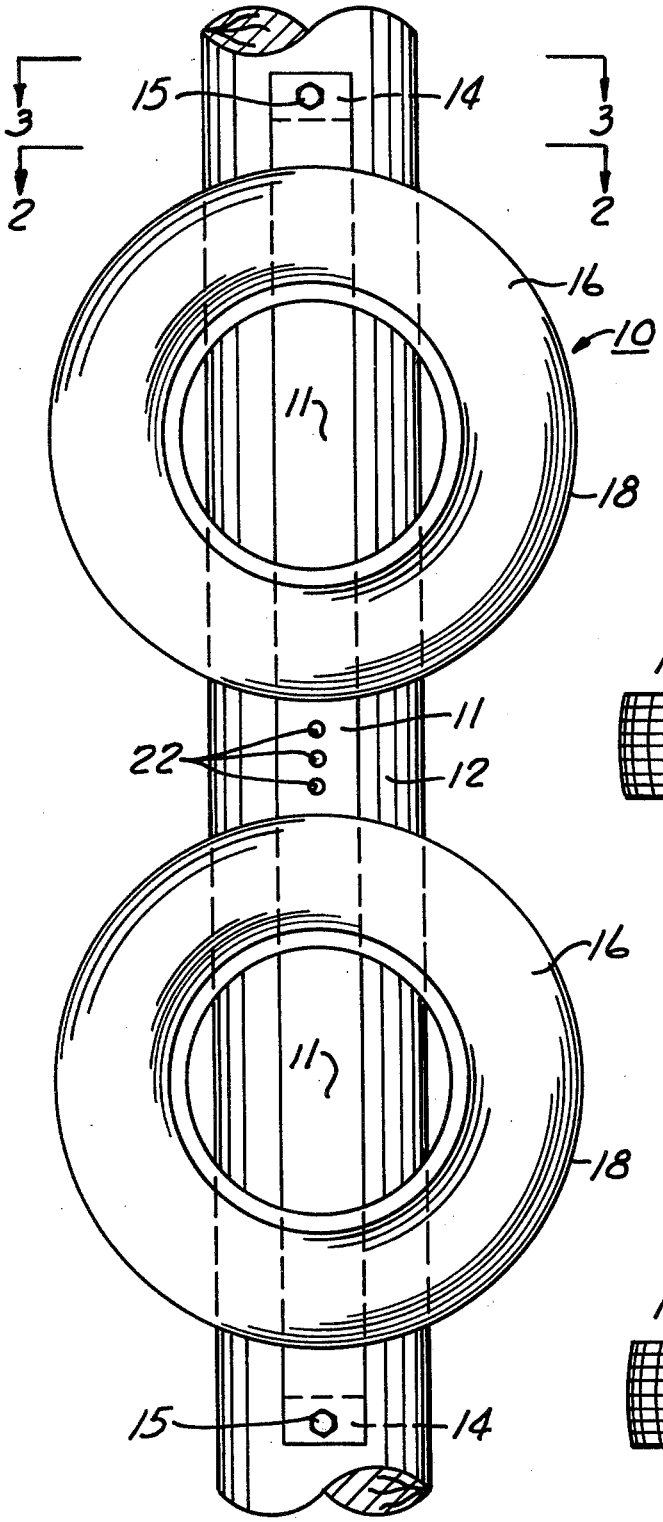
FIG. 1 is a view in side elevation of the pole guard of the present invention secured to a section of vertical pole.
Figure 2:
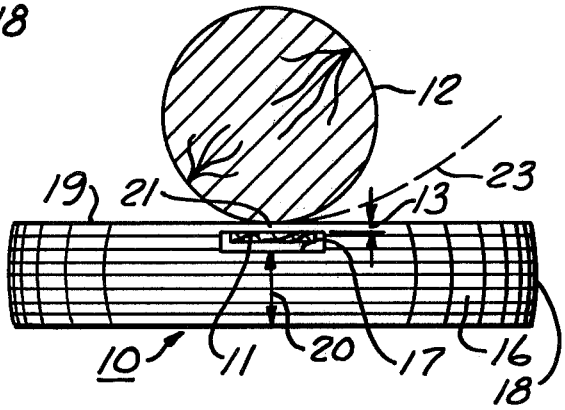
FIG. 2 is a plan view in partial section of the pole guard shown in FIG. 1 as seen along line 2—2.
Figure 3:
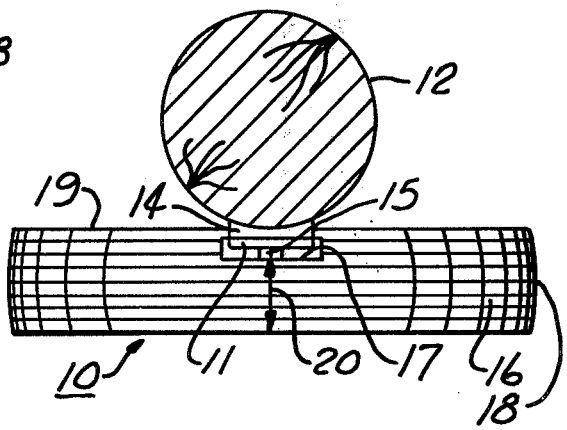
FIG. 3 is a plan view in partial section of the pole guard shown in FIG. 1 as seen along line 3—3.

The wood strip 11 is secured in a spaced relationship from the surface of pole 12 as indicated at 13 in FIG. 2. This spaced relationship is maintained by the use of wooden spacers 14, which are best illustrated in FIG. 3. The wood strip 11 together with the spacer blocks 14 are rigidly secured to the pole by means of lag screws 15.

The yielding and deflecting part of the pole guard of the present invention is provided by means of the used or worn rubber vehicle tires 16. These normally are worn conventional automobile pneumatic tires.

Tires 16 are larger in diameter than pole 12 in order to provide the necessary deflecting and positive push off action on impact as previously explained.

As is best illustrated in FIGS. 2 and 3, diametrically opposed slots 17, which are the same or slightly larger than the cross section of wood strip 11, are cut into the perimetal worn annular face 18 of each tire and slidably receive the wood strip 11 therethrough.

These diametrically opposed slots 17 are positioned adjacent one side face 19 of the tire 16 in order to leave maximum tire thickness 20 in front of the guard for yielding impact protection and also to provide minimum tire width 21 (FIG. 2) to fit between the wood strip 11 and the outer surface of pole 12.

The tire portion 21 between strip 11 and pole 12 is under pressure or squeezed to a limited extent between the pole and the wood strip, but not to such a degree that the tire 16 cannot be slid up or down the wood strip 11. This frictional engagement will hold the tires in the preselected positions along wood strip 11, but additional stops may be provided in the strip 11 to make certain that the tires 16 do not accidentally slide downward. Such stops may be provided in the form of bolts or wooden pegs which are inserted in the holes or openings 22 in the wood strip 11. These stops extend inwardly towards the pole within the spacing 13, but do not extend out beyond the outer face of the wooden strip 11 in order to stop downward movement of the tire 16 along strip 11 and eliminate any hard protruding objects on the outer face of wood strip 11 upon which an individual might be injured.

When an individual makes impact or contact with the tires 16, the sides of the tire 16 will deflect rearwardly as indicated by dashed line 23 in FIG. 2. This causes the individual to slide with the deflection of the tire away from the pole and the spring action of the tire in recovering its original shape also pushes or urges the individual out and away from the pole to minimize injury, whereas the conventional pads do nothing more than absorb some of the impact.

I claim:

1. A pole guard comprising a substantially rigid strip secured longitudinally to a pole and in spaced relation thereto, at least one used vehicle tire larger in diameter than the pole and having diametrically opposed slots in the perimetal annular face of said tire, said slots being adjacent one side face of said tire and slidably receiving said strip therethrough with said one side face facing said pole.

2. The pole guard of claim 1 including stop means on said strip to position said tire therealong at a predetermined position.

3. The pole guard of claim 1 including a plurality of said tires so positioned along said strip.

4. The pole guard of claim 3 including stop means on said strip to position said tires therealong at predetermined positions.

5. The pole guard of claim 1 wherein said at least one tire is painted a desired color.

6. The method of manufacturing a pole guard comprising the steps of cutting diametrically opposed slots in at least one used vehicle tire annular perimetal face adjacent one side face thereof, sliding a substantially rigid strip through said slots, and longitudinally securing said strip to a pole in spaced relation therefrom with said one face facing said pole.

7. The method of claim 6 including the step of providing a stop on said strip to pre-position said tire therealong.

8. The method of claim 6 including the step of painting said tire a desired color.

* * * * *